US010315203B2

(12) United States Patent
Mackel et al.

(10) Patent No.: US 10,315,203 B2
(45) Date of Patent: Jun. 11, 2019

(54) OUTLET NOZZLE FOR A CENTRIFUGE DRUM

(71) Applicant: GEA Mechanical Equipment GmbH, Oelde (DE)

(72) Inventors: Wilfried Mackel, Lippetal-Herzfeld (DE); Juergen Teigeler, Oelde (DE); Volker Kassera, Starzach-Sulzau (DE)

(73) Assignee: GEA Mechanical Equipment GmbH, Oelde (DE)

( * ) Notice: Subject to any disclaimer, the term of this patent is extended or adjusted under 35 U.S.C. 154(b) by 239 days.

(21) Appl. No.: 14/649,879

(22) PCT Filed: Dec. 3, 2013

(86) PCT No.: PCT/EP2013/075300
§ 371 (c)(1),
(2) Date: Jun. 4, 2015

(87) PCT Pub. No.: WO2014/086735
PCT Pub. Date: Jun. 12, 2014

(65) Prior Publication Data

US 2015/0306606 A1 Oct. 29, 2015

(30) Foreign Application Priority Data

Dec. 5, 2012 (DE) ..... 10 2012 111 801

(51) Int. Cl.
*B04B 1/12* (2006.01)
*B04B 5/12* (2006.01)
(Continued)

(52) U.S. Cl.
CPC ..... *B05B 1/02* (2013.01); *B04B 1/12* (2013.01); *B04B 5/12* (2013.01); *B04B 11/02* (2013.01);
(Continued)

(58) Field of Classification Search
CPC ..... B04B 1/12; B04B 11/02; B04B 2005/125; B05B 1/02; B05B 15/02
(Continued)

(56) References Cited

U.S. PATENT DOCUMENTS 2,060,239 A 11/1936 Peltzer
2,557,629 A * 6/1951 Boivinet ..... B04B 1/00 422/270
(Continued)

FOREIGN PATENT DOCUMENTS

CN 87 2 14261 U 3/1988
CN 1168109 A 12/1997
(Continued)

OTHER PUBLICATIONS

Chinese Office Action issued in Chinese counterpart application No. 201380063381.1 dated Jun. 24, 2016, with partial English translation (Three (3) pages).
(Continued)

*Primary Examiner* — Walter D. Griffin
*Assistant Examiner* — Shuyi S. Liu
(74) *Attorney, Agent, or Firm* — Crowell & Moring LLP

(57) ABSTRACT

An outlet nozzle for centrifuge drums is disclosed. The outlet nozzle includes a nozzle body which has an inlet channel extending axially therein and an outlet channel extending at an obtuse angle to the inlet channel. The outlet channel has an inlet opening and an outlet opening, where the diameter of the outlet channel increases at least in certain portions. The point on the outlet channel which is narrowest in terms of the cross-section is formed by the inlet opening itself and the cross-section of the outlet channel is not reduced at any point over the axial length of the outlet channel in the outlet direction.

8 Claims, 3 Drawing Sheets

(51) Int. Cl.
*B05B 1/02* (2006.01)
*B04B 11/02* (2006.01)
*B05B 15/50* (2018.01)

(52) U.S. Cl.
CPC ..... *B04B 2005/125* (2013.01); *B05B 15/50* (2018.02)

(58) Field of Classification Search
USPC ..... 494/56; 239/589
See application file for complete search history.

(56) References Cited

U.S. PATENT DOCUMENTS

| | | | | |
|---|---|---|---|---|
| 2,560,239 | A | 7/1951 | O'Farrell | |
| 2,695,748 | A | 11/1954 | Millard | |
| 5,033,680 | A * | 7/1991 | Schultz | B04B 1/12 239/223 |
| 5,916,083 | A * | 6/1999 | Bjorkstrom | B04B 7/08 494/56 |
| 2007/0135289 | A1* | 6/2007 | Mackel | B04B 1/14 494/38 |
| 2009/0140081 | A1* | 6/2009 | Turcic | B04B 1/12 239/589 |
| 2013/0310242 | A1 | 11/2013 | Madsen et al. | |

FOREIGN PATENT DOCUMENTS

| | | | | |
|---|---|---|---|---|
| DE | 42 343 | A1 | 11/1965 | |
| DE | 39 22 619 | C1 | 10/1990 | |
| DE | 41 05 903 | A1 | 8/1992 | |
| DE | 195 27 039 | C1 | 12/1996 | |
| DE | 19527039 | C1 * | 12/1996 | B04B 1/12 |
| WO | WO 97/18900 | A1 | 5/1997 | |
| WO | WO 02/078859 | A1 | 10/2002 | |

OTHER PUBLICATIONS

Zhiru Yang, "Studies and Optimal Designs of Disc Centrifuge", China Master's Theses Full-text Database, Volume of Agricultural Technology, Issue 09, 2008, 2 total pages.

PCT/EP2013/075300, International Search Report (PCT/ISA/220 and PCT/ISA/210) dated Feb. 10, 2015, with partial English translation, enclosing Written Opinion of the International Searching Authority (PCT/ISA/237) (Eleven (11) pages).

German Search Report dated Oct. 8, 2013, with Statement of Relevancy (Six (6) pages).

* cited by examiner

OUTLET NOZZLE FOR A CENTRIFUGE DRUM

This application claims the priority of International Application No. PCT/EP2013/075300, filed Dec. 3, 2013, and German Patent Document No. 10 2012 111 801.9, filed Dec. 5, 2012, the disclosures of which are expressly incorporated by reference herein.

BACKGROUND AND SUMMARY OF THE INVENTION

The invention relates to an outlet nozzle for a centrifuge drum.

Outlet nozzles of the prior art are disclosed in DE 39 22 619 C1, DE 41 05 903 A1, and U.S. Pat. No. 2,560,239.

Moreover, an outlet nozzle of the generic type is also disclosed in DE 195 27 039 C1. According to the teachings of DE 195 27 039 C1, the diameter of the entry opening of the outlet nozzle in the region of the nozzle body is either of identical size to the diameter of the outlet duct, is larger by a maximum of 50 percent or is smaller by 50 percent than the diameter of the outlet duct. Moreover, the inlet space steadily increases up to a maximum diameter. The diameter of the outlet duct in the nozzle brick initially tapers down to a bottleneck, and then in the case of one of the variants of DE 195 27 039 C1 widens out in a conical manner by an angle of at least 5°.

The outlet nozzle per se has indeed proven to be successful.

However, it is nevertheless desirable for the blocking tendency of the outlet nozzle to be further reduced and for the exit jet to be positively influenced. The solution to this issue is the object of the invention.

Accordingly, the narrowest point of the outlet duct in terms of cross section is formed by the entry opening per se, and it is provided that the cross section of the outlet duct across preferably the entire axial length of the outlet duct in the exit direction is not decreased at any point, apart from a production radius on the inlet which may optionally be provided.

The blocking tendency and the nozzle jet formation are in this manner reduced by a modification of the design embodiment of the outlet duct of the nozzle brick, which is implementable in a simple manner.

Advantageous design embodiments may be derived from the dependent claims.

In the following the invention is described in more detail by means of an exemplary embodiment with reference to the figures.

DETAILED DESCRIPTION OF THE DRAWINGS

Figure 2:
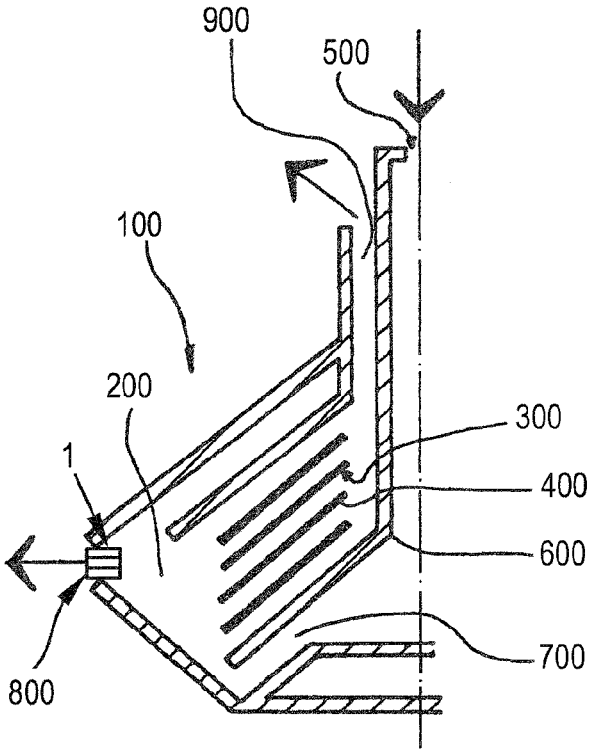
FIG. 2 shows a schematic illustration of a known separator drum.

FIG. 2 shows a biconical separator drum 100 which is conceived for continuous operation.

The separator drum 100 has a vertical rotation axis. In the conical or even biconical separator drum 100, respectively, a stack 300 of conical separator plates 400 is disposed in the spinner space 200. The separator plates 400 are disposed on a distributor shaft 600. A supply pipe 500 serves for supplying a product to be processed to distributor ducts 700.

The distributor ducts 700 open out into the spinner space 200 in which the product is clarified of solids and optionally separation into two or more liquid phases of various density is performed. One or a plurality of drains 900, which may be provided with peeling disks, for liquid phases serve to discharge the at least one liquid phase. In contrast thereto, the solids are evacuated from the separator drum 100 to the outside by exit openings 800 which are distributed along the circumference, preferably in the region of the largest circumference of the separator drum. To this end, in each case one outlet nozzle 1 is inserted into the exit openings 800.

Figure 1:
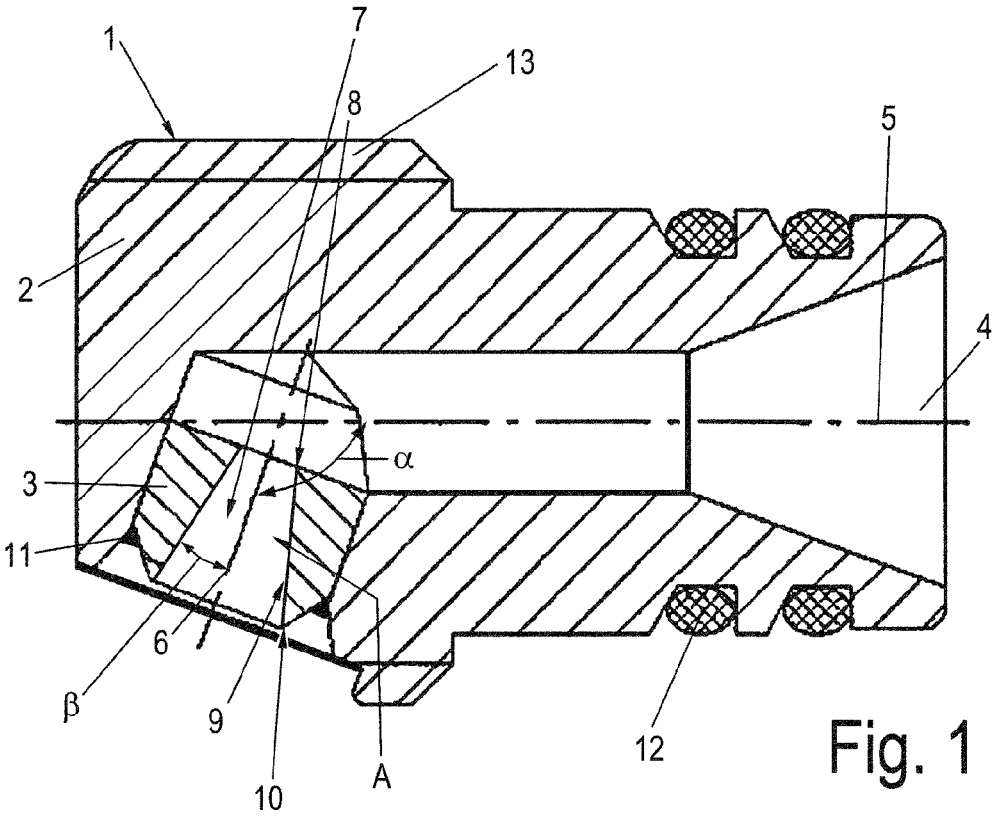
FIG. 1 shows a cross section of an outlet nozzle according to the invention.

FIG. 1 shows a first preferred embodiment of the outlet nozzle 1 according to the invention.

The outlet nozzle 1 has a nozzle body 2, which is configured as a nozzle holder, and a nozzle brick 3 which is inserted into the nozzle body 2.

An axially running inlet duct 4 is configured in the nozzle body 2, and an outlet duct 7 extending at an obtuse angle to the inlet duct is configured in the nozzle brick 3. The symmetry axis 5 of the inlet duct 4 and the symmetry axis 6 of the outlet duct 7 of the nozzle brick 3 are oriented so as to be angled in relation to one another, wherein the thus enclosed angle is an obtuse angle "$\alpha$" to which preferably the condition $90° < \alpha < 160°$ applies.

The outlet duct 7 in the nozzle brick 3 has an entry opening 8 and an exit opening 10 which is spaced apart from the former by an axial distance z in the exit direction A.

Proceeding from the entry opening, the outlet duct 7 widens up to the diameter of the exit opening 10, that is to say that the diameter of the outlet duct 7 in the nozzle brick 3 increases from the entry opening 8 up to the exit opening 10.

The narrowest point of the outlet duct 7 of the nozzle brick 3 in terms of the cross section is in this manner formed by the entry opening 8 per se of the nozzle brick 3, wherein the cross section of the exit opening 10 according to the invention is always larger than the cross section of the entry opening 8 of the outlet duct 7 of the nozzle brick 3. Preferably, the cross section of the outlet duct 7 across the axial length of the outlet duct 7 in the exit direction A is not decreased at any point. This results in a reduced blocking tendency and improved focusing of the jet.

The nozzle brick 3 preferably is a component which is rotationally symmetrical across its entire length, simplifying the manufacture of the same in comparison with the prior art of the generic type. The nozzle brick 3 is preferably configured so as to be planar and flat on the axial end side thereof in the region of the entry opening.

Figure 3:
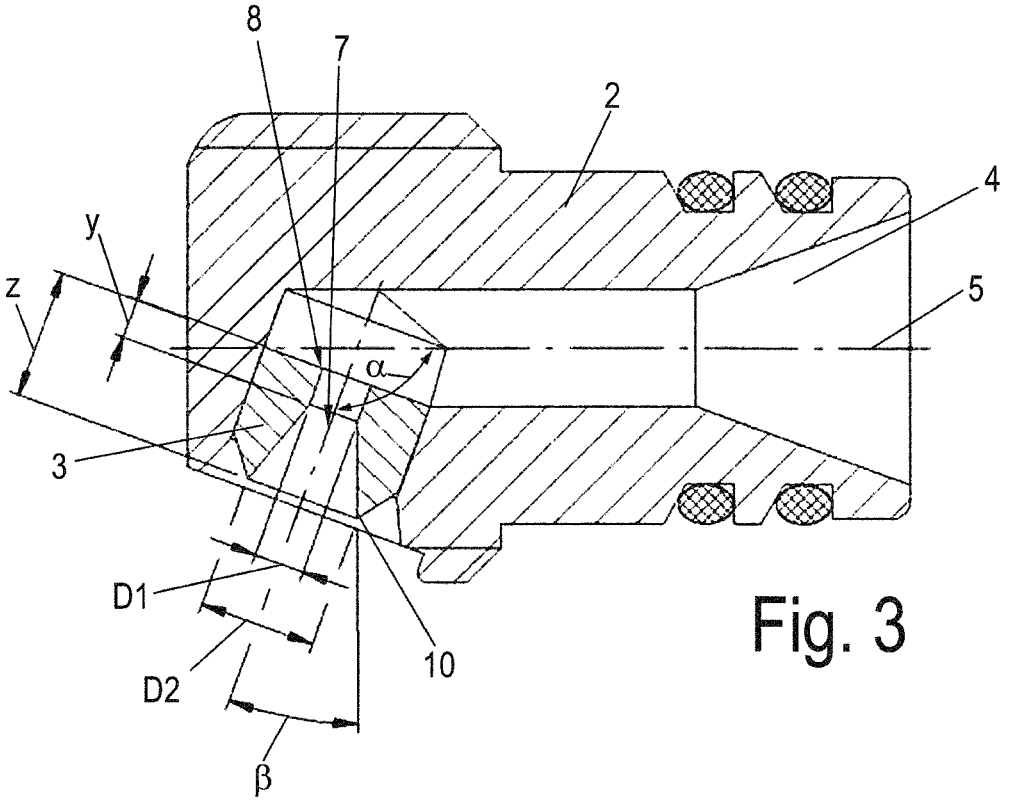
FIGS. 3-6 show further outlet nozzles according to the invention, with and without a nozzle brick.

A solder 11 for fastening the nozzle brick on the nozzle body is preferably located between the nozzle body 2 and the nozzle brick 3 on the outer circumference of the nozzle brick 3. Alternatively, a seal (which engages in an annular groove, for example, not illustrated here) may also be provided in this region if the nozzle brick 3 is to be releasable (for example when the latter is to be held in the nozzle body 2 by way of threads). FIG. 3 shows a nozzle body 2 of this type which is configured as a nozzle holder, with a nozzle brick 3 (similar to FIG. 1). According to the exemplary embodiment of FIG. 3, the nozzle brick 3 may be screwed into the nozzle holder 2. Here, the seal between the outer circumference of the nozzle body 3 and the nozzle holder is not drawn in FIG. 3.

Figure 4:
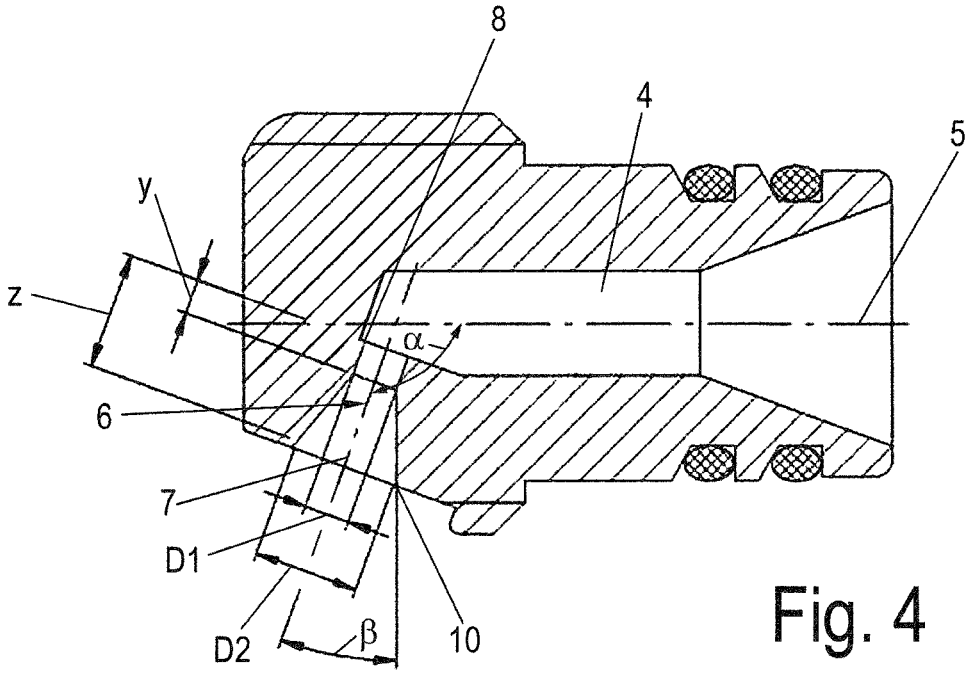
Figure 5:
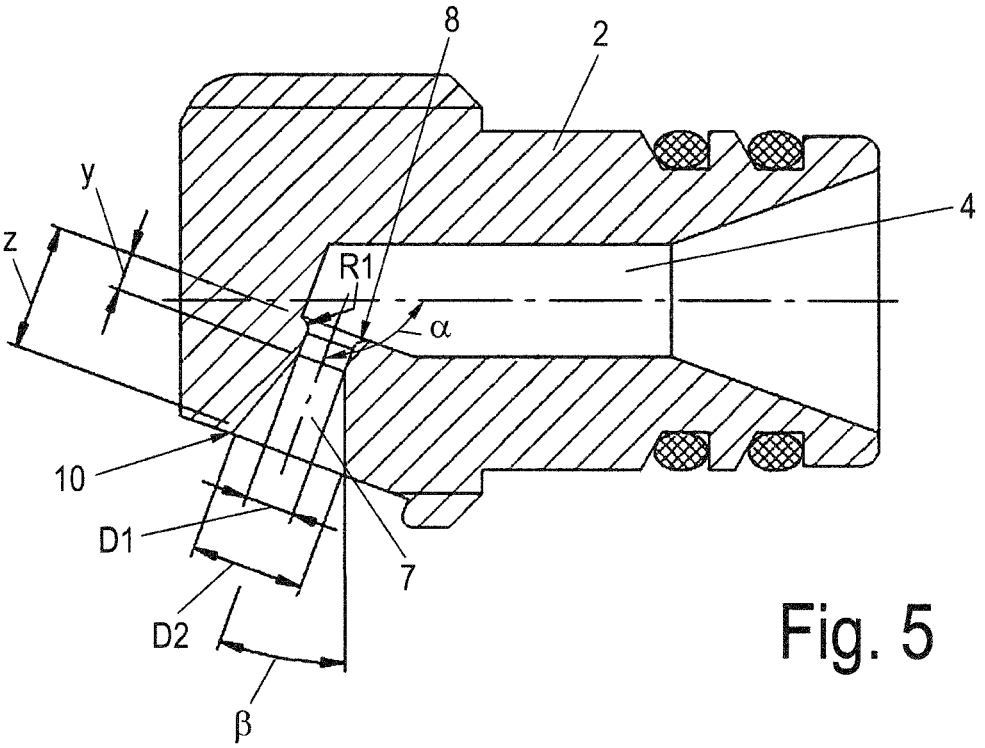
Figure 6:
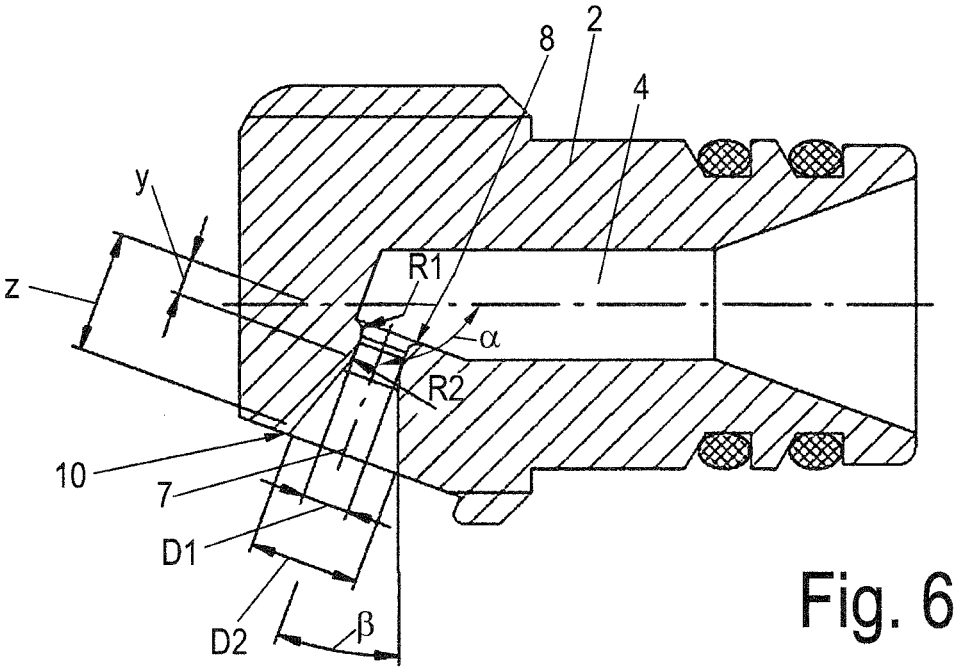

Here, FIGS. 1 and 3 show solutions having a nozzle body 2 which is configured as a nozzle holder and into which the nozzle brick 3 is inserted, and FIGS. 4 to 6 show solutions in which a nozzle brick 3 is dispensed with. Instead, the outlet duct 7 which runs at an obtuse angle to the inlet duct 4, according to FIGS. 4 to 6 is directly configured in the nozzle body 2 per se, which then is in one part (wherein in this case a sufficiently hard material is used for manufacturing the nozzle body 2). On account thereof, regions in which contamination may build up can be reduced even further.

The outlet duct 7 in all exemplary embodiments widens out continuously or in portions across its axial length. If and when a nozzle brick 3 is present (FIG. 1), the outlet duct 7 preferably widens out in a conical manner across its axial length.

As already explained, the outlet duct 7 preferably widens out in a constant and steady manner across its entire axial length. This is advantageous but is not mandatory. The cross section of the outlet duct 7 which in the cross section preferably is circular may indeed increase in a non-uniform manner across the axial length of the outlet duct 7, or else not increase in a first internal region having a length y (FIG. 3: nozzle body with nozzle brick, FIG. 4: nozzle body without nozzle brick), such that the diameter of the outlet duct 7 in this first region of the entry opening is constant across the axial distance y (diameter D1), which diameter D1 of the outlet duct 7, which in this portion in the cross section preferably is circular, is adjoined in the exit direction by the widening exit cone 9, the largest diameter D2 of which is larger than the diameter D1 (FIGS. 3 to 6).

In the region of the entry opening 8 the outlet duct 7, on the preferably circular circumferential periphery may have an encircling production radius R1. The latter may have a very sharp edge (i.e. the radius R1 is negligibly small and may be set to zero), or rather be somewhat larger (preferably less than 3 mm, in particular less than 1 mm). The production radius R1 preferably is dimensioned in such a manner that it extends across less than 10% of the axial extent z of the outlet duct 7. The radius R1 preferably transcends into that region of the outlet duct 7 in which the latter has its smallest diameter D1. The production radius 7 reduces wear on the entry opening 8 of the outlet duct 7.

According to FIG. 6, a second radius R2 (which is aligned so as to widen out in the outflow direction) adjoins the production radius R1, which radius R2 is designed in such a manner that a transition in the form of a sharp edge in the region of the transition from the production radius R1 to the widening cone 9 is avoided.

Seals 12 on the outer circumference of the nozzle body 2 seal the outlet nozzle 1 in relation to the drum wall. Furthermore, a thread 13 enables the nozzle body 2 to be screwed into the drum wall or into the openings 800 in the drum wall, respectively. A bayonet catch or similar is also conceivable.

The design embodiment of the outlet duct 7, preferably in the nozzle brick 3, is particularly advantageous in all exemplary embodiments. Since the outlet duct 7 from the region of the entry opening 8 up to the region of the exit opening 10 does not taper down anywhere, but since the outlet duct 7 from the entry opening 8 up to the exit opening 10 continuously opens up in a conical manner (if applicable, up to the mentioned production radius), a significantly lower blocking tendency in comparison with the prior art is achieved, in particular also when the consistency of the product to be processed changes.

Preferably, the angle of inclination β of the conical region 9 of the outlet duct 7 in relation to the symmetry axis 6 of the outlet duct 7 is 5° to 45°, in particular 10° to 30°, and particularly preferably 30° to 45°. In this range, the blocking tendency is reduced in a particularly significant manner.

Preferably, the diameter of the outlet duct 7 increases by more than 50%, in particular more than 75%, across its axial length, on account of which particularly good operational behavior is achieved.

The inlet duct 4 does not widen out in a conical manner, as in the prior art, but it initially tapers down in a uniform manner to a constant diameter which extends across the major part of the axial length of the inlet duct, or the inlet duct 4, respectively.

As already mentioned, according to FIG. 4, no nozzle brick 3 is provided in the nozzle body 2, but is configured in the nozzle body per se so as to be one part therewith, wherein the latter has the axially running inlet duct 4 and the outlet duct 7 which runs at an obtuse angle to the inlet duct and which has the entry opening 8 and the exit opening 10, wherein the diameter of the outlet duct 7 increases in portions in such a manner that the narrowest point of the outlet duct 7 in terms of cross section is formed by the entry opening 8 per se, wherein the cross section of the outlet duct 7 across the axial length of the outlet duct 7 in the exit direction A is not decreased at any point. If and when a sufficiently hard material is selected, the nozzle brick made from a harder material than the material of the nozzle holder may be dispensed with.

The absolute nozzle diameter D1 on the entry opening 8 depends on the consistency of the solid phase of the product to be processed. The diameter D1 is selected by way of experiment in such a manner that a constant exit flow from the outlet nozzle is formed. Preferably, the following applies to the diameter D1: 0.5 mm<=D1<=5 mm.

Preferably, the ratio of the axial length y of the portion of the outlet duct having a constant diameter to the entire axial length z of the exit duct 7 fulfills the following condition: y/z<=½.

The absolute nozzle diameter D2 on the exit opening preferably is significantly larger than the diameter Dl on the entry opening 8, in particular is at least twice the size.

Furthermore preferably, the axial length z of the exit duct fulfills the following condition: 4 mm<=z<=30 mm. Moreover, it is advantageous for the ratio of the axial length y of a portion of the exit duct having a constant diameter to the diameter to fulfill the following condition: 1<=y/D1<=5.

In these ranges, particularly good operational behavior is in each case achieved.

LIST OF REFERENCE SIGNS

Outlet nozzle 1
Nozzle body 2
Nozzle brick 3
Inlet duct 4
Symmetry axis 5
Symmetry axis 6
Outlet duct 7
Entry opening 8
Exit cone 9
Exit opening 10
Solder 11
Seal 12
Thread 13
Spinner drum 100
Spinner space 200
Stack of separator plates 300
Separator plate 400
Supply pipe 500

Distributor 600
Distributor duct 700
Opening in drum wall 800
Drain 900
Angle α, β
Diameter D1, D2
Radii R1, R2
Lengths y, z

The invention claimed is:

1. An outlet nozzle for a centrifuge drum, comprising:

a nozzle body which has an inlet duct running axially therein and an outlet duct running at an obtuse angle to the inlet duct;

wherein the outlet duct has an entry opening and an exit opening;

wherein a narrowest point of the outlet duct in terms of cross-section is formed by the entry opening, wherein the cross-section of the outlet duct across an axial length of the outlet duct in an exit direction is not decreased at any point, and wherein, proceeding from the entry opening to the exit opening, a diameter of the outlet duct, which in cross-section is circular, increases at every point;

wherein the nozzle body is a nozzle holder, wherein a nozzle brick which is composed of a harder material than the nozzle holder is disposed in the nozzle holder, and wherein the outlet duct with the entry opening and the exit opening is disposed in the nozzle brick and runs axially therein;

wherein the outlet nozzle is disposed in an exit opening of a separator drum having a vertical rotation axis;

wherein an angle of conicity β of the outlet duct in relation to a center axis of the outlet duct is $\beta>5°$ and wherein $\beta<45°$.

2. The outlet nozzle as claimed in claim 1, wherein a production radius is configured on a circumferential periphery of the entry opening.

3. The outlet nozzle as claimed in claim 1, wherein the cross-section of the outlet duct is circular across an entire axial length of the outlet duct.

4. The outlet nozzle as claimed in claim 1, wherein, proceeding from the entry opening in the nozzle brick to the exit opening in the nozzle brick, the diameter of the outlet duct constantly increases in a uniform manner.

5. The outlet nozzle as claimed in claim 1, wherein the diameter of the outlet duct increases by more than 50 percent across the axial length of the outlet duct.

6. The outlet nozzle as claimed in claim 1, wherein a smallest diameter D1 of the outlet duct is $0.5\text{ mm} <= D1 <= 5\text{ mm}$.

7. The outlet nozzle as claimed in claim 6, wherein a largest diameter D2 of the outlet duct is at least twice D1.

8. The outlet nozzle as claimed in claim 1, wherein the axial length z of the outlet duct is $4\text{ mm} <= z <= 30\text{ mm}$.

* * * * *